US010611012B2

(12) United States Patent
Adelman et al.

(10) Patent No.: US 10,611,012 B2
(45) Date of Patent: Apr. 7, 2020

(54) SYSTEMS AND METHODS FOR A MULTITOOL

(71) Applicant: Nite Ize, Inc., Boulder, CO (US)

(72) Inventors: Gregory M. Adelman, Boulder, CO (US); Ian M. Core, Pittsburgh, PA (US)

(73) Assignee: Nite Ize, Inc., Boulder, CO (US)

( * ) Notice: Subject to any disclaimer, the term of this patent is extended or adjusted under 35 U.S.C. 154(b) by 222 days.

(21) Appl. No.: 14/907,902

(22) PCT Filed: Jul. 29, 2014

(86) PCT No.: PCT/US2014/048671
§ 371 (c)(1),
(2) Date: Jan. 27, 2016

(87) PCT Pub. No.: WO2015/017440
PCT Pub. Date: Feb. 5, 2015

(65) Prior Publication Data

US 2016/0167213 A1 Jun. 16, 2016

Related U.S. Application Data

(63) Continuation of application No. 29/461,942, filed on Jul. 29, 2013, now Pat. No. Des. 709,344.
(Continued)

(51) Int. Cl.
*B25F 1/00* (2006.01)
*B25B 15/00* (2006.01)
*B25B 13/08* (2006.01)

(52) U.S. Cl.
CPC ..... *B25F 1/00* (2013.01); *B25B 13/08* (2013.01); *B25B 15/00* (2013.01); *B25B 15/007* (2013.01)

(58) Field of Classification Search
CPC . B25F 1/00; B25B 13/08; B25B 15/00; B25B 15/007; B25B 13/06; B25B 13/56; B25B 13/04; B25B 13/48
See application file for complete search history.

(56) References Cited

U.S. PATENT DOCUMENTS 869,706 A 10/1907 Hamilton
888,848 A 5/1908 Rapson
(Continued)

FOREIGN PATENT DOCUMENTS

CN 2007/0000063 A1 1/2007
CN 202174590 U 3/2012
(Continued)

OTHER PUBLICATIONS

International Search Report in co-pending PCT Application No. PCT/US201/048671 dated Nov. 14, 2014 (3 pages).
(Continued)

*Primary Examiner* — Robert J Scruggs
(74) *Attorney, Agent, or Firm* — Haynes and Boone, LLP

(57) ABSTRACT

A multitool includes a carabineer gate. The multitool further includes a body portion. The body portion includes a carabineer portion, the carabineer portion including a hook portion and apertures for receiving the carabineer gate. The body portion further includes a wrench portion, the wrench portion located in a portion of the carabineer portion, the wrench portion including a first aperture sized to receive a nut. The body portion further includes a screwdriver portion and a bottle opener portion.

20 Claims, 3 Drawing Sheets

Related U.S. Application Data

(60) Provisional application No. 61/859,904, filed on Jul. 30, 2013.

(56) References Cited

U.S. PATENT DOCUMENTS

| | | | | |
|---|---|---|---|---|
| 1,187,842 | A | 6/1916 | Kaas | |
| D151,280 | S | 10/1948 | Merritt | |
| 2,716,367 | A * | 8/1955 | Montgomery | B25B 13/04 81/124.3 |
| D197,915 | S | 4/1964 | Ayars | |
| D235,091 | S * | 5/1975 | Daenen | D8/104 |
| 4,238,862 | A | 12/1980 | Leatherman | |
| D334,702 | S | 4/1993 | Godsey | |
| 5,259,281 | A * | 11/1993 | Burke | B25B 13/04 7/138 |
| D356,240 | S * | 3/1995 | Meldahl | D8/105 |
| 6,058,539 | A | 5/2000 | Mitford-Taylor | |
| D431,105 | S | 9/2000 | Ling | |
| 6,223,372 | B1 | 5/2001 | Barber | |
| D477,523 | S | 7/2003 | Malvasio | |
| D513,579 | S | 1/2006 | Barber et al. | |
| D515,903 | S * | 2/2006 | Kelleghan | D8/105 |
| 7,254,856 | B2 * | 8/2007 | Goldberg | B25B 15/00 7/164 |
| D596,011 | S | 7/2009 | Almayda | |
| 7,698,970 | B1 * | 4/2010 | Chavez | B25B 13/04 7/138 |
| 2014/0059782 | A1 * | 3/2014 | Duncan | B25F 1/00 7/138 |

FOREIGN PATENT DOCUMENTS

| | | |
|---|---|---|
| CN | 202448116 U | 9/2012 |
| CN | 202846423 U | 4/2013 |

OTHER PUBLICATIONS

Office Action and Search Report dated Dec. 16, 2016 in related Chinese App. No. 201480043353.8 (13 pages with English translation).

* cited by examiner

SYSTEMS AND METHODS FOR A MULTITOOL

CROSS-REFERENCE TO RELATED APPLICATIONS

This application is a National Stage of PCT Application No. PCT/US2014/048671 filed on Jul. 29, 2014, which PCT application claims the benefit of U.S. Provisional Application No. 61/859,904 filed Jul. 30, 2013, and U.S. Design application No. 29/461,942 filed Jul. 29, 2013, now U.S. Pat. No. D709,344 issued Jul. 22, 2014. The above patent applications are hereby incorporated by reference to the same extent as though fully contained herein.

TECHNICAL FIELD

Some embodiments disclosed in this application relate to a small tool having multiple purposes and applications.

BACKGROUND

Various tools may be useful in numerous situations. Tools such as bottle openers, screwdrivers, and wrenches find such usage; however, typically they are bulky and difficult to carry. A tool that would accomplish many tasks that the above tools do and would be easy to carry and transport would be useful.

SUMMARY

In one embodiment, a multitool includes a carabineer gate. The multitool further includes a body portion. The body portion includes a carabineer portion, the carabineer portion including a hook portion and apertures for receiving the carabineer gate. The body portion further includes a wrench portion, the wrench portion located in a portion of the carabineer portion, the wrench portion including a first aperture sized to receive a nut. The body portion further includes a screwdriver portion and a bottle opener portion. Optionally, the first aperture has a stepped shape, and the first aperture has three portions, each having a different width, each different width corresponding to a standard nut width. Alternatively, the screwdriver portion is located proximate to the wrench portion as compared to the hook portion. In one configuration, the bottle opener portion is located between the wrench portion and the screwdriver portion. In another configuration, a ruler portion is located along an edge of the body portion, the edge opposite and parallel to the carabineer gate. In one alternative, the screwdriver portion includes a wedge edge portion. In another alternative, the body portion is approximately the size of a standard key. Optionally, the bottle opener portion is on a same side of the body as the carabineer gate. Alternatively, the body portion is formed from a single piece of material and is unitary. In one alternative, the carabineer gate and bottle opener portion are located on a first side of the multitool. In another alternative, a ruler portion is located along an edge of the body portion, the edge opposite and parallel to the carabineer gate, and the edge of the body portion is a longest continuous straight side of the body portion. Optionally, the bottle opener portion is located on the body portion such that the longest continuous straight side functions as a lever arm for the bottle opener portion. Alternatively, a width of the carabineer portion is less than half of a length of the carabineer portion.

In one embodiment, a method of using a multitool includes providing a multitool. The multitool includes a carabineer gate. The multitool further includes a body portion. The body portion includes a carabineer portion, the carabineer portion including a hook portion and apertures for receiving the carabineer gate. The body portion further includes a wrench portion, the wrench portion located in a portion of the carabineer portion, the wrench portion including a first aperture sized to receive a nut. The body portion further includes a screwdriver portion and a bottle opener portion. The method further includes clipping the multitool to a key chain using the carabineer portion. The method further includes utilizing one of the wrench portion, screwdriver portion, and bottle opener portion to complete a task.

DETAILED DESCRIPTION OF THE DRAWINGS

Described herein are embodiments of systems and methods for a multitool. Embodiments of the multitool provide the user with a convenient tool that combines the features of a screwdriver, a wrench for various sizes of nuts and bolts, a bottle opener, and a ruler. The features are combined in a convenient system that includes a carabineer system that is easily connected to a keychain, loop, or other point.

Figure 1:
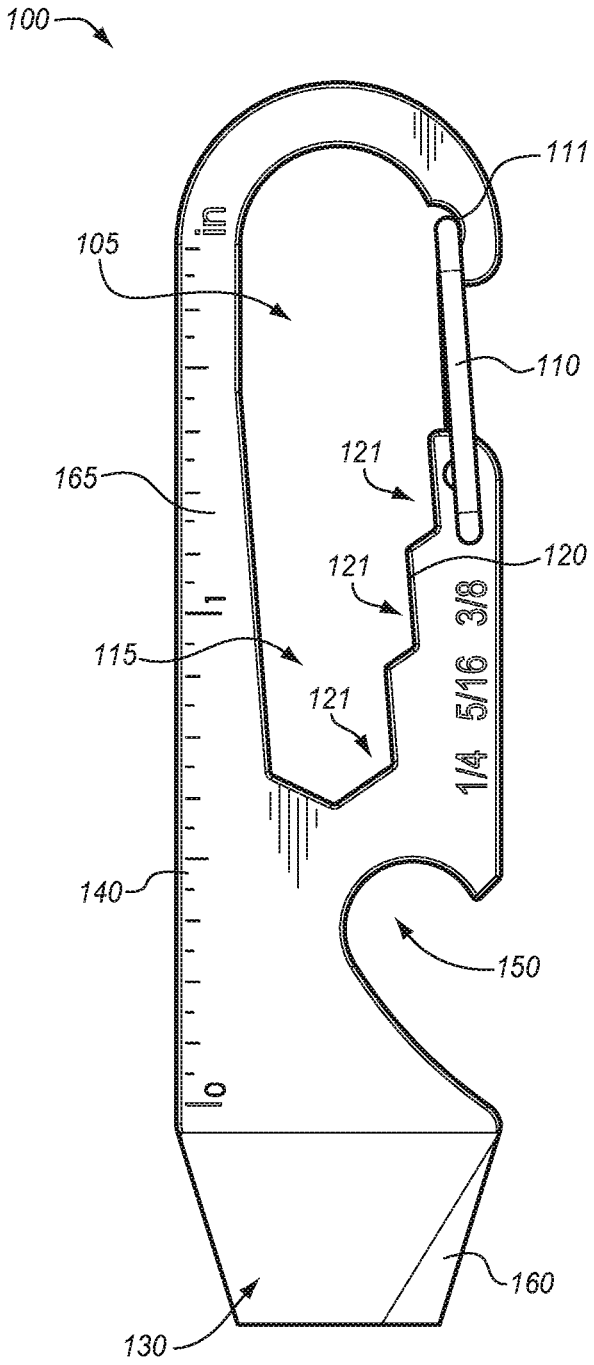
FIG. 1 shows a first side of one embodiment of a multitool.
Figure 2:
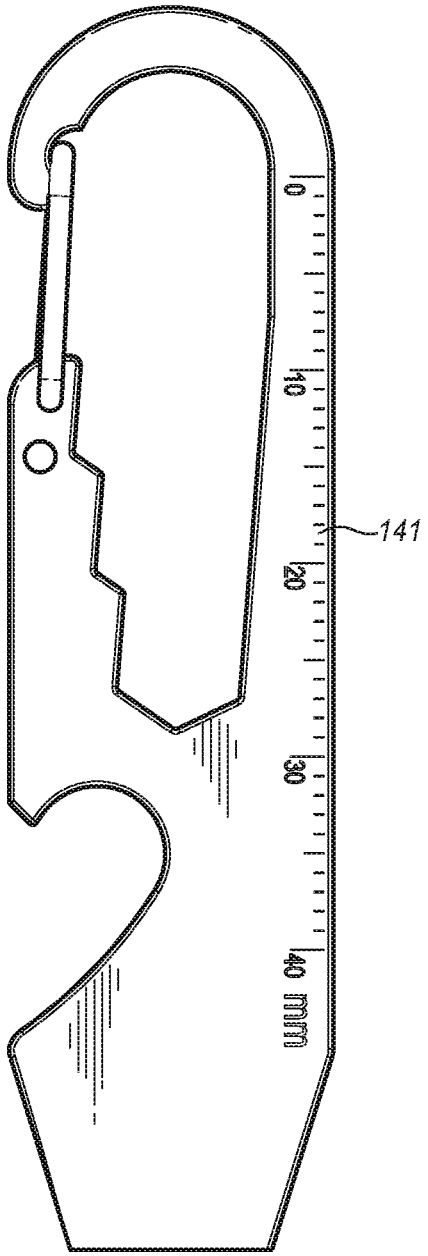
FIG. 2 shows the opposite side of the multitool of FIG. 1.
Figure 3:
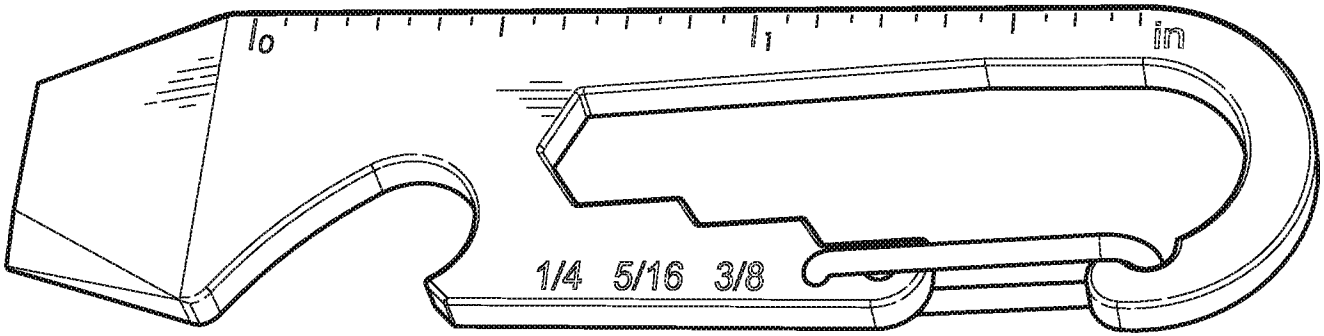
FIG. 3 shows a perspective view of the multitool of FIG. 1.

FIG. 1 shows one embodiment of a multitool 100. Multitool 100 includes a carabineer portion 105, which includes a gate 110 and gate receiver 111. Multitool 100 has been combined with a wrench portion 115, such that wrench portion 115 and carabineer portion 105 form a single shape. Wrench portion 115 includes a stepped wrench portion 120, which has differently sized apertures for receiving differently sized nuts and bolts. Multitool 100 includes slot 121 for ⅜ of an inch, slot 122 for 5/16 of an inch, and slot 123 for ¼ of an inch. Various alternatives may include differently sized apertures. By arranging these slots in a stepped fashion, stepped wrench portion 120 can work with multiple sizes of nuts and bolts without providing a separate slot for each size. Further, the combination of stepped wrench portion 120 with carabineer portion 105 and wrench portion 115 provides additional space savings and eliminates potentially redundant portions. Because of the size and shape of multitool 100, a user may use portions of multitool 100 extending away from wrench portion 115 for leverage.

Furthermore, multitool 100 includes a screwdriver portion 130 that is shaped and sized such that it may be used with flathead and Phillips type screws. Multitool 100 further includes a ruler 140 with a first measurement scale such as English units for inches. On the opposite side, another ruler 141 may be printed or engraved that includes metric units such as centimeters. Multitool 100 further includes a bottle opener 150. Furthermore, wedge edge 160 has been narrowed to provide a somewhat sharp cutting surface that can be used to cut things under significant pressure and pry and wedge items.

Multitool 100 has only one moving part, gate 110, and except for gate 110 may be formed out of a single piece of material. In many embodiments, this piece of material is stainless steel. The unitary construction provides for a strong and easy-to-make item.

Furthermore, multitool 100 is approximately the same size as a standard key, providing for an easily detachable and reattachable tool that is compact. Bottle opener 150 is located on the same side of the body as carabineer gate 110. This location is unexpected, but provides for increased performance of bottle opener 150, since the opposing side 165 provides for a solid lever arm.

By combining the wrench portion 115 with the carabineer portion 105 there is a significant space savings in the device, while still allowing it to be easily clipped to a key ring or other item. This is unusual in that it requires the reshaping of the carabineer portion 105 to accommodate the wrench portion 115. Unexpectedly, by creating a slimmer carabineer portion, the multitool is better adapted for clipping into a keychain, since the resulting width and length is similar to that of a key. Furthermore, the lengthening allows for better leverage when utilizing the multitool 100 as a wrench. Reshaping of the carabineer portion 105 was also necessary for the inclusion of ruler 141. In order to include ruler 141, a flat and straight portion must be included in the multitool 100. By arranging for this flat portion to occur on the side opposite the carabineer gate 100, a needed length may be achieved. Additionally, the inclusion bottle opener 150 on the opposing side allows for increased tool and space utilization.

The previous detailed description is of a small number of embodiments for implementing the systems and methods for a multitool and is not intended to be limiting in scope. The following claims set forth a number of the embodiments of the systems and methods for a multitool disclosed with greater particularity.

The invention claimed is:

1. A multitool comprising:

a carabineer gate;

a body portion, including:

a carabineer portion, the carabineer portion including a hook portion and apertures for receiving the carabineer gate;

a wrench portion, the wrench portion located in a portion of the carabineer portion, the wrench portion including a first aperture sized to receive a nut;

a screwdriver portion; and a bottle opener portion, wherein the first aperture has a stepped shape, and the first aperture has three portions, each having a different width, each different width corresponding to a standard nut width, wherein the body portion includes a first outer side edge extending from the carabineer gate to the bottle opener portion and a second outer side edge extending from the hook portion to the screwdriver portion, the first and second outer side edges extending parallel to each other, and wherein the wrench portion is located centrally between the screwdriver portion and the hook portion and centrally between the first and second outer side edges.

2. The multitool of claim 1, wherein the screwdriver portion is located proximate to the wrench portion as compared to the hook portion.

3. The multitool of claim 2, wherein the screwdriver portion includes a wedge edge portion.

4. The multitool of claim 1, wherein the bottle opener portion is located between the wrench portion and the screwdriver portion.

5. The multitool of claim 4, wherein the bottle opener portion is on a same side of the body as the carabineer gate.

6. The multitool of claim 1, wherein a ruler portion is located along an edge of the body portion, the edge opposite to the carabineer gate.

7. The multitool of claim 1, wherein the body portion is approximately the size of a standard key.

8. The multitool of claim 1, wherein the body portion is formed from a single piece of material and is unitary.

9. The multitool of claim 1, wherein the carabineer gate and bottle opener portion are located on a first side of the multitool.

10. The multitool of claim 9, wherein a ruler portion is located along an edge of the body portion, the edge opposite and parallel to the carabineer gate, and the edge of the body portion is a longest continuous straight side of the body portion.

11. The multitool of claim 10, wherein the bottle opener portion is located on the body portion such that the longest continuous straight side functions as a lever arm for the bottle opener portion.

12. The multitool of claim 11, wherein a width of the carabineer portion is less than half of a length of the carabineer portion.

13. The multitool of claim 1, wherein the portion of the carabineer is a portion internal to the hook portion.

14. The multitool of claim 1, wherein the portion of the carabineer is in the hook portion.

15. The multitool of claim 1, wherein the first aperture is defined by opposing first and second surfaces defining the different widths of the three portions, the first surface being linear across the three portions, and the second surface having the stepped shape to provide the different widths of the three portions.

16. A method of using a multitool, comprising:

providing a multitool, the multitool including:

a carabineer gate;

a body portion, including:

a carabineer portion, the carabineer portion including a hook portion and apertures for receiving the carabineer gate;

a wrench portion, the wrench portion located in a portion of the carabineer portion, the wrench portion including a first aperture sized to receive a nut, wherein the first aperture has a stepped shape, and the first aperture has three portions, each having a different width, each different width corresponding to a standard nut width;

a screwdriver portion; and a bottle opener portion, wherein the body portion includes a width defined between parallel first and second outer side edges and a length defined between the hook portion and the screwdriver portion, and wherein the wrench portion is located centrally along the width and length of the body portion;

clipping the multitool to a key chain using the carabineer portion; and utilizing one of the wrench portion, screwdriver portion, and bottle opener portion to complete a task.

17. A multitool comprising:

a carabineer gate;

a body portion, including:

a carabineer portion on a first end of the body portion, the carabineer portion including a hook portion and apertures for receiving the carabineer gate;

a wrench portion, the wrench portion located in a portion of the carabineer portion, the portion of the carabineer being a portion internal to the hook, the wrench portion including a first aperture sized to receive a nut;

a screwdriver portion; and a bottle opener portion on a second end of the body portion, wherein the first aperture has a stepped shape, and the first aperture has three portions, each having a different width, each different width corresponding to a standard nut width, wherein the body portion includes a width defined between parallel first and second outer side edges of the body portion and a length between the first and second ends of the body portion, and wherein the wrench portion is located centrally along the width and length of the body portion.

18. The multitool of claim 17, wherein the body portion includes a longitudinal centerline along the length and between the first and second outer side edges, and wherein the screwdriver portion extends along the longitudinal centerline.

19. The multitool of claim 18, wherein the screwdriver portion extends from the second end of the body portion.

20. The multitool of claim 18, wherein each of the three portions of the first aperture is centered along the longitudinal centerline of the body portion.

* * * * *